US006609502B1

(12) United States Patent
Frank

(10) Patent No.: US 6,609,502 B1
(45) Date of Patent: Aug. 26, 2003

(54) HIGH-PRESSURE FUEL RESERVOIR

(75) Inventor: Kurt Frank, Schorndorf (DE)

(73) Assignee: Robert Bosch GmbH, Stutgart (DE)

( * ) Notice: Subject to any disclaimer, the term of this patent is extended or adjusted under 35 U.S.C. 154(b) by 12 days.

(21) Appl. No.: 09/806,675

(22) PCT Filed: Aug. 1, 2000

(86) PCT No.: PCT/DE00/02528

§ 371 (c)(1),
(2), (4) Date: May 11, 2001

(87) PCT Pub. No.: WO01/09506

PCT Pub. Date: Feb. 8, 2001

(30) Foreign Application Priority Data

Aug. 3, 1999 (DE) ..... 199 36 535

(51) Int. Cl.[7] ..... F02M 55/02
(52) U.S. Cl. ..... 123/469; 123/456; 123/468
(58) Field of Search ..... 123/456, 468, 123/469; 285/332.2, 332.3, 334.1, 334.2, 353

(56) References Cited

U.S. PATENT DOCUMENTS 5,169,182 A * 12/1992 Hashimoto ..... 285/332.2
5,775,302 A * 7/1998 Guido et al. ..... 123/468

FOREIGN PATENT DOCUMENTS

DE 19606946 * 9/1997
JP 9-303232 * 11/1997

* cited by examiner

*Primary Examiner*—Tony M. Argenbright
(74) *Attorney, Agent, or Firm*—Ronald E. Greigg

(57) ABSTRACT

The invention relates to a high-pressure fuel reservoir a common rail fuel injection system of an internal combustion engine, with a plurality of fittings for connection fuel lines. In order to improve the mobility of the fuel lines in the connections, an intermediary piece is disposed in each of the fittings between the high-pressure fuel reservoir and the fuel lines.

19 Claims, 1 Drawing Sheet

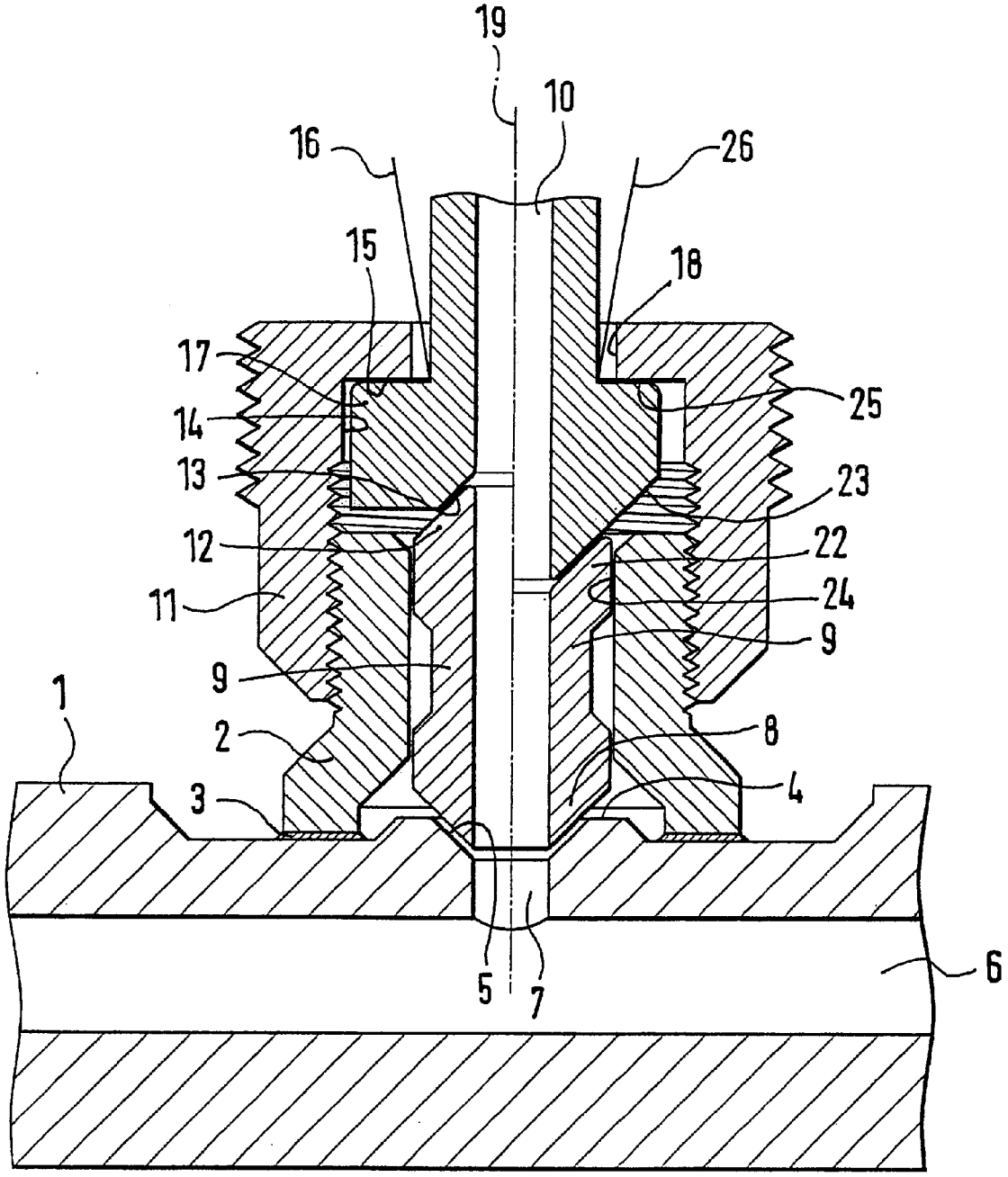
19
10
16
26
15
18
17
25
14
13
23
12
22
11
24
9
9
1
2
8
3
4
5
7
6

HIGH-PRESSURE FUEL RESERVOIR

CROSS-REFERENCE TO RELATED APPLICATIONS

This application is a 35 USC 371 application of PCT/DE 00/02528 filed on Aug. 1, 2000.

BACKGROUND OF THE INVENTION

1. Field of the Invention

The invention relates to a high-pressure fuel reservoir for a common rail fuel injection system of an internal combustion engine, with a number of fittings for fuel lines.

2. Description of the Prior Art

In common rail injection systems, a high-pressure fuel pump, possibly with the aid of a presupply pump, supplies the fuel to be injected from a tank to the central high-pressure fuel reservoir, which is referred to as the common rail. Fuel lines lead from the rail to the individual injectors which are associated with the cylinders of the internal combustion engine. The injectors are individually triggered by the engine electronics as a function of the operating parameters of the engine in order to inject fuel into the combustion chamber of the engine. The pressure production and the injection are decoupled from each other by the high-pressure fuel reservoir.

A conventional high-pressure fuel reservoir is described, for example, in DE 195 48 611. The known high-pressure fuel reservoir is comprised of an elongated, tubular body with a number of connections for supplying injectors. The ends of the fuel lines can only move to a limited degree in the fittings of the high-pressure fuel reservoir. The lack of mobility of the fuel lines in the fittings of the high-pressure fuel reservoir turns out to be disadvantageous during installation of the high-pressure fuel reservoir in the engine.

The object of the invention is to embody a high-pressure fuel reservoir of the type described at the beginning so that the ends of the fuel lines are sufficiently mobile in the fittings. Despite the sufficient mobility, the seal at these fittings should also be assured at high pressures. In addition, the high-pressure fuel reservoir according to the invention should be simple in design and inexpensive to produce.

SUMMARY OF THE INVENTION

In a high-pressure fuel reservoir for a common rail fuel injection system of an internal combustion engine with a number of fittings for fuel lines, the object is attained by virtue of the fact that an intermediary piece is disposed in each of the fittings between the high-pressure fuel reservoir and the fuel lines. The mobility of the fuel lines in the fittings is improved considerably by means of the intermediary piece. Manufacturing-and assembly-related tolerances can be compensated for by the improved mobility.

One particular embodiment of the invention is characterized in that the intermediary piece is essentially the shape of a hollow cylinder with two conical end faces which cooperate with complementary end faces in the fuel line and in the high-pressure fuel reservoir. The conical end faces produce a favorable sealing action when the complementary end faces are braced against each other.

Another particular embodiment of the invention is characterized in that an external thread is provided on the fitting, which cooperates with the internal thread of a securing nut so that the fuel line is braced with its free end against the intermediary piece and the intermediary piece is braced against the high-pressure fuel reservoir. The securing nut permits the fuel lines to be rapidly mounted onto the high-pressure fuel reservoir.

Another particular embodiment of the invention is characterized in that the end of the intermediary piece oriented toward the high-pressure fuel reservoir and the end of the intermediary piece oriented away from the high-pressure fuel reservoir are tapered and that a radial support surface for the fuel line is embodied on the securing nut. The symmetrical embodiment of the intermediary piece simplifies its installation because the installer does not have to pay attention to the orientation of the intermediary piece as it is inserted into the fitting.

Another particular embodiment of the invention is characterized in that the end of the intermediary piece oriented toward the high-pressure fuel reservoir is tapered, that the end of the intermediary piece oriented away from the high-pressure fuel reservoir is funnel-shaped, and that the intermediary piece is supported with at least a part of its external circumferential surface against the internal circumferential surface of the fitting. If the intermediary piece has an asymmetrical shape, then on the end face oriented toward the fuel line, it could be stretched open by the complementary end face of the fuel line. Such a stretching open is prevented by the fact that the intermediary piece is supported with at least a part of its outer circumferential surface against the inner circumferential surface of the fitting.

Another particular embodiment of the invention is characterized in that the fittings are welded onto the high-pressure fuel reservoir. This embodiment offers the advantage that the seal in relation to the outside is produced directly at the high-pressure fuel reservoir. The intersecting point between the fitting and high-pressure fuel reservoir does not have to be designed as high-pressure-tight. This reduces manufacturing costs.

BRIEF DESCRIPTION OF THE DRAWINGS

Other advantages, features, and details of the invention ensue from the following description in which two exemplary embodiments of the invention are described in detail with reference to the drawing.

DESCRIPTION OF THE PREFERRED EMBODIMENTS

The accompanying FIGURE shows a detail from a longitudinal section through a high-pressure fuel reservoir according to the invention. The high-pressure fuel reservoir shown is comprised of a tubular base body 1 with an elongated, circular, cylindrical inner chamber 6. The inner chamber 6 of the tubular base body 1 communicates with an injector (not shown) of an internal combustion engine by means of a lateral connection 7, a fitting 2, and a high-pressure fuel line 10.

For the sake of clarity, only one connection point is shown in the FIGURE represented. Naturally, a connection point for each injector is provided on the tubular base body 1. Furthermore, the tubular base body 1 is provided with additional connection points for the fuel supply, pressure sensors, etc.

The fitting 2 has the form of a stepped, circular, hollow cylinder with three sections which have different diameters. The external thread is embodied on the section with the smallest diameter. The end face of the section with the largest diameter is secured to the tubular base body 1 by means of a welded connection 3.

Inside the fitting 2, the tubular base body 1 is provided with a concentric raised area 4 in the form of a round disk. In the center of the raised area 4, there is a funnel-shaped opening 5, which feeds into the lateral connection 7.

A tapering end 8 of an intermediary piece 9 rests against the funnel-shaped opening 5 of the tubular base body 1 in a pressure-tight manner. The intermediary piece 9 has the form of a hollow cylinder and is braced between the fuel line 10 and the tubular base body 1 with the aid of a securing nut 11. To this end, the internal thread of the securing nut 11 cooperates with the external thread of the fitting 2. After assembly, the fuel line 10 extends through a circular recess 18 which is provided in the center of the securing nut 11.

The fitting 2, the intermediary piece 9, the fuel line 10, and the securing nut 11 are rotationally symmetrical parts. Two different embodiments of the invention are shown to the left and right of the rotational axis 19.

In the embodiment shown on the left side of the rotational axis 19, the intermediary piece 9 is tapered at its end 12 oriented away from the tubular base body 1. The tapered end 12 of the intermediary piece 9 cooperates with a complementary sealing cone 13 on the fuel line 10. In order to prevent the end of the fuel line 10 resting against the intermediary piece from being stretched open, a support surface 14 is embodied on the securing nut 11 and rests against a collar 17 that is embodied at the end of the fuel line 10.

In addition, an annular clamping surface 15 is embodied on the end face of the securing nut 11. The clamping surface 15 is used to press the sealing cone 13 embodied on the fuel line 10 against the tapered end 12 of the intermediary piece 9. In addition, the tapered end 8 of the intermediary piece 9 is pressed into the funnel-shaped opening 5 of the tubular base body 1. A line 16 indicates that the fuel line 10 can be deflected by an angle of approximately 10° after assembly.

An essential aspect of the current invention is that the interior of the fuel line 10 is connected by means of the intermediary piece 9 to the inner chamber 6 of the tubular base body 1 in a high-pressure-tight manner without the connection between the fitting 2 and the tubular base body 1 having to be designed as high-pressure-tight. There is nevertheless a sufficient mobility of the fuel line 10 after installation, as indicated by the line 16.

In the embodiment shown on the right side of the rotational axis 19, the end 22 of the intermediary piece 9 oriented away from the tubular base body 1 is embodied as funnel-shaped. The funnel-shaped end 22 of the intermediary piece 9 rests against a complementary sealing cone 23 which is embodied at the end of the fuel line 10. In order to prevent the intermediary piece 9 from being stretched open in this region, a support surface 24 is provided on the fitting 2 and rests against the outer circumference of the intermediary piece 9.

The intermediary piece 9 is braced between the fuel line 10 and the tubular base body 1 by means of a clamping surface 25 that is embodied on the securing nut 11. A line 26 indicates that sufficient deflection of the fuel line 10 after assembly is possible in this embodiment as well.

The mobility of the fuel line 10 is assured by the slight distance between the sealing cone 13, 23 at the end of the fuel line 10 and the clamping surface 15, 25. The recess 18 must also be of sufficient size.

The foregoing relates to preferred exemplary embodiments of the invention, it being understood that other variants and embodiments thereof are possible within the spirit and scope of the invention, the latter being defined by the appended claims.

What is claimed is:

1. In a high-pressure fuel reservoir for a common rail fuel injection system of an internal combustion engine, with a number of fittings (2) for fuel lines (10), the improvement comprising an intermediary piece (9) is disposed in each of the fittings (2) between the high-pressure fuel reservoir (1) and the fuel lines (10), wherein the end (22) of the intermediary piece (9) oriented away from the high-pressure fuel reservoir (1) is funnel-shaped and that the intermediary piece (9) is supported with at least a part (24) of its external circumference surface against the internal circumference surface of the fitting (2).

2. The high-pressure fuel reservoir according to claim 1, wherein the intermediary piece (9) is essentially the shape of a hollow cylinder with two conical end faces (8; 12, 22) which cooperate with complementary end faces (5; 13, 22) on the high-pressure fuel reservoir (1) and the associated fuel line (10).

3. The high-pressure fuel reservoir according to claim 1, wherein the fittings (2) are welded onto the high-pressure fuel reservoir (1).

4. In a high-pressure fuel reservoir for a common rail fuel injection system of an internal combustion engine, with a number of fittings (2) for fuel lines (10), the improvement comprising an intermediary piece (9) is disposed in each of the fittings (2) between the high-pressure fuel reservoir (1) and the fuel lines (10), wherein the intermediary piece (9) is essentially the shape of a hollow cylinder with two conical end faces (8; 12, 22) which cooperate with complementary end faces (5; 13, 22) on the high-pressure fuel reservoir (1) and the associated fuel line (10), and wherein an external thread is provided on the fitting (2), which cooperates with the internal thread of a securing nut (11) so that the fuel line (10) is braced with its free end against the intermediary piece (9) and the intermediary piece (9) is braced against the high-pressure fuel reservoir (1).

5. The high-pressure fuel reservoir according to claims 4, wherein the end (8) of the intermediary piece (9) oriented toward the high-pressure fuel reservoir (1) is tapered.

6. The high-pressure fuel reservoir according to claim 5, wherein the end (12) of the intermediary piece (9) oriented away from the high-pressure fuel reservoir (1) is tapered and that a radial support surface (14) for the fuel line (10) is embodied on the securing nut (11).

7. The high-pressure fuel reservoir according to claim 6, wherein the fittings (2) are welded onto the high-pressure fuel reservoir (1).

8. The high-pressure fuel reservoir according to claim 5, wherein the end (22) of the intermediary piece (9) oriented away from the high-pressure fuel reservoir (1) is funnel-shaped and that the intermediary piece (9) is supported with at least a part (24) of its external circumference surface against the internal circumference surface of the fitting (2).

9. The high-pressure fuel reservoir according to claim 5, wherein the fittings (2) are welded onto the high-pressure fuel reservoir (1).

10. The high-pressure fuel reservoir according to claim 4, wherein the fittings (2) are welded onto the high-pressure fuel reservoir (1).

11. The high-pressure fuel reservoir according to claims 4, wherein the end (8) of the intermediary piece (9) oriented toward the high-pressure fuel reservoir (1) is tapered, wherein the fittings (2) are welded onto the high-pressure fuel reservoir (1).

12. The high-pressure fuel reservoir according to claim 11, wherein the end (12) of the intermediary piece (9) oriented away from the high-pressure fuel reservoir (1) is tapered and that a radial support surface (14) for the fuel line (10) is embodied on the securing nut (11).

13. The high-pressure fuel reservoir according to claim 4, wherein the end (8) of the intermediary piece (9) oriented toward the high-pressure fuel reservoir (1) is tapered.

14. The high-pressure fuel reservoir according to claim 13, wherein the end (12) of the intermediary piece (9) oriented away from the high-pressure fuel reservoir (1) is tapered and that a radial support surface (14) for the fuel line (10) is embodied on the securing nut (11).

15. The high-pressure fuel reservoir according to claim 13, wherein the fittings (2) are welded onto the high-pressure fuel reservoir (1).

16. The high-pressure fuel reservoir according to claim 4, wherein the end (22) of the intermediary piece (9) oriented away from the high-pressure fuel reservoir (1) is funnel-shaped and that the intermediary piece (9) is supported with at least a part (24) of its external circumference surface against the internal circumference surface of the fitting (2).

17. The high-pressure fuel reservoir according to claim 4, wherein the end (22) of the intermediary piece (9) oriented away from the high-pressure fuel reservoir (1) is funnel-shaped and that the intermediary piece (9) is supported with at least a part (24) of its external circumference surface against the internal circumference surface of the fitting (2).

18. The high-pressure fuel reservoir according to claim 4, wherein the fittings (2) are welded onto the high-pressure fuel reservoir (1).

19. In a high-pressure fuel reservoir for a common rail fuel injection system of an internal combustion engine, with a number of fittings (2) for fuel lines (10), the improvement comprising an intermediary piece (9) is disposed in each of the fittings (2) between the high-pressure fuel reservoir (1) and the fuel lines (10), the intermediary piece (9) being essentially the shape of a hollow cylinder with two conical end faces (8; 12) which cooperate with complementary end faces (5; 13) on the high-pressure fuel reservoir (1) and the associated fuel line (10), the two conical end faces are both convex faces.

* * * * *